US005988067A

United States Patent [19]

Ishida et al.

[11] Patent Number: 5,988,067

[45] Date of Patent: Nov. 23, 1999

[54] METHOD AND APPARATUS FOR CONTROLLING INK FILM THICKNESS

[75] Inventors: Masaaki Ishida; Tetsuya Okuda; Hiroyuki Sugiyama, all of Ibaragi, Japan

[73] Assignee: Komori Corporation, Japan

[21] Appl. No.: 09/211,099

[22] Filed: Dec. 15, 1998

[30] Foreign Application Priority Data

Dec. 26, 1997 [JP] Japan ..... 9-359634

[51] Int. Cl.[6] ..... B41F 31/04

[52] U.S. Cl. ..... 101/484; 101/183; 101/350.1

[58] Field of Search ..... 101/365, 350.1, 101/350.2, 350.3, 350.4, 351.3, 352.01, 352.05, 352.09, 483, 484, 485, DIG. 32, DIG. 38, 181, 183, 136, 137, 138, 141, 363

[56] References Cited

U.S. PATENT DOCUMENTS 4,660,470 4/1987 Kramp et al. ..... 101/365
5,010,820 4/1991 Loffler ..... 101/484
5,070,784 12/1991 Nishida et al. ..... 101/365
5,148,747 9/1992 Rodi et al. ..... 101/137 X
5,447,102 9/1995 Pfeiffer et al. ..... 101/148

*Primary Examiner*—J. Reed Fisher
*Attorney, Agent, or Firm*—Blakely Sokoloff Taylor & Zafman

[57] ABSTRACT

In an ink film thickness control method, second ink film thickness distribution, corresponding to an image on an old printing plate, on a minimum first ink film thickness distribution formed on the surface of an ink roller group and required during printing, is removed for a predetermined one of printing units thereby leaving the first ink film thickness distribution. Which one of pre-inking I mode and pre-inking II mode is to be performed is set for each printing unit. The minimum first ink film thickness distribution required during printing is formed on the surface of the ink roller group of the printing unit set in the pre-inking I mode after a new printing plate is mounted in the printing unit set in the pre-inking I mode. The second ink film thickness distribution corresponding to the image of the new printing plate is superposed on the first ink film thickness distribution. For the printing unit set in the pre-inking II mode, the second ink film thickness distribution is formed simultaneously on the first ink film thickness distribution which has already been formed. An ink film thickness control apparatus is also disclosed.

14 Claims, 9 Drawing Sheets

METHOD AND APPARATUS FOR CONTROLLING INK FILM THICKNESS

BACKGROUND OF THE INVENTION

The present invention relates to a method and apparatus for controlling an ink film thickness in an ink supply unit (inker) which supplies an ink in an ink fountain to a printing plate through an ink roller group.

FIG. 9 shows the main part of an ink supply unit in each printing unit of a web offset printing press. An ink supply unit 11 shown in FIG. 9 has an ink fountain 1, an ink 2 stored in the ink fountain 1, an ink fountain roller 3, a plurality of ink fountain keys 4, an ink ductor roller 5, an ink roller group 6, a printing plate 7, a plate cylinder 8, a plurality of nozzles 9, and an ink roller cleaning unit 10. The ink fountain keys 4 are aligned in the axial direction of the ink fountain roller 3. The nozzles 9 are arranged in the axial direction of the ink roller group 6 to discharge a solvent.

Through opening degree adjustment of the ink fountain keys 4, the ink supply unit 11 having the above arrangement supplies the ink 2 in the ink fountain 1 to the ink fountain roller 3, and supplies the ink, which has been supplied to the ink fountain roller 3, to the printing plate 7 through the ink roller group 6 upon the feed operation of the ink ductor roller 5.

When an old printing plate is exchanged for a new printing plate 7, the opening degree of the ink fountain keys 4, the rotation ratio of the ink fountain roller 3, and the like are preset in accordance with the image of the new printing plate 7. More specifically, after the opening degree of the ink fountain keys 4, the rotation ratio of the ink fountain roller 3, and the like are set in accordance with the image of the new printing plate 7, the ink 2 in the ink fountain 1 is supplied to the new printing plate 7 through the ink roller group 6. In this case, test printing is performed before final printing to adjust the ink supply amount, thus obtaining a satisfactory color tone. A desired ink film thickness distribution (gradient of the ink film thickness) is accordingly formed in the ink roller group 6.

This pre-inking operation is already described in U.S. Ser. No. 08/884,348, now U.S. Pat. No. 5,884,562 and U.S. Ser. No. 08/884,349 filed by the present applicant.

In the conventional ink supply unit 11, when the old printing plate is exchanged for the new printing plate 7, an ink film thickness distribution corresponding to the old printing plate remains in the ink roller group 6. In this case, color change is performed or not, depending on the new printing plate 7.

When color change is not performed, while the ink is left in the ink roller group 6, the ink film thickness distribution corresponding to the old printing plate is gradually changed to an ink film thickness distribution corresponding to the new printing plate 7. Accordingly, adjustment of the ink supply amount and test printing are required excessively until a satisfactory color tone is obtained, causing an increase in pre-printing preparation time, an increase in labor load, waste of printing material, a decrease in production efficiency, an increase in cost, and the like.

In the color change, an ink cleaning operation is performed, and the ink in the ink fountain 1 is exchanged. Thus, the ink roller group 6 no longer holds an ink, and an ink film thickness distribution corresponding to the new printing plate 7 must be formed in the ink roller group 6 from the beginning. Therefore, it takes time until the ink film thickness distribution reaches an equilibrium state, causing an increase in pre-printing preparation time, an increase in labor load, waste of printing material, a decrease in production efficiency, an increase in cost, and the like.

In conventional ink film thickness control, a time-series ink film thickness distribution forming operation is performed for each printing unit independently. This delays start of final printing, interferes with the productivity, and increases the production cost. The ink film thickness distribution forming operation differs from one printing unit to another to require an complicated operation, and accordingly imposes an excessive work load to the operator. Since similar operations are performed repeatedly, operation errors are difficult to prevent. A work loss always occurs, and an unnecessary ink film thickness correcting operation is performed.

SUMMARY OF THE INVENTION

It is an object of the present invention to provide a method and apparatus for controlling an ink film thickness, which can shorten the pre-printing preparation time, reduce the labor load, economize the printing material, improve the production efficiency, decrease the production cost, prevent operation errors, and the like.

In order to achieve the above object, according to the present invention, there is provided an ink film thickness control method comprising the steps of removing, for a predetermined one of a plurality of printing units respectively having ink supply units which include ink roller groups and connected in series to perform multi-color printing, a second ink film thickness distribution, corresponding to an image on an old printing plate, on a minimum first ink film thickness distribution formed on a surface of the ink roller group and required during printing, thereby leaving the first ink film thickness distribution, setting which one of pre-inking I mode and pre-inking II mode is to be performed for each of the printing units, forming the minimum first ink film thickness distribution required during printing on the surface of the ink roller group of the printing unit set in the pre-inking I mode after a new printing plate is mounted in the printing unit set in the pre-inking I mode, superposing the second ink film thickness distribution, corresponding to the image of the new printing plate, on the first ink film thickness distribution, and simultaneously forming, for the printing unit set in the pre-inking II mode, the second ink film thickness distribution on the first ink film thickness distribution which has already been formed.

DESCRIPTION OF THE PREFERRED EMBODIMENT

The present invention will be described in detail with referring to the accompanying drawings.

Figure 2:
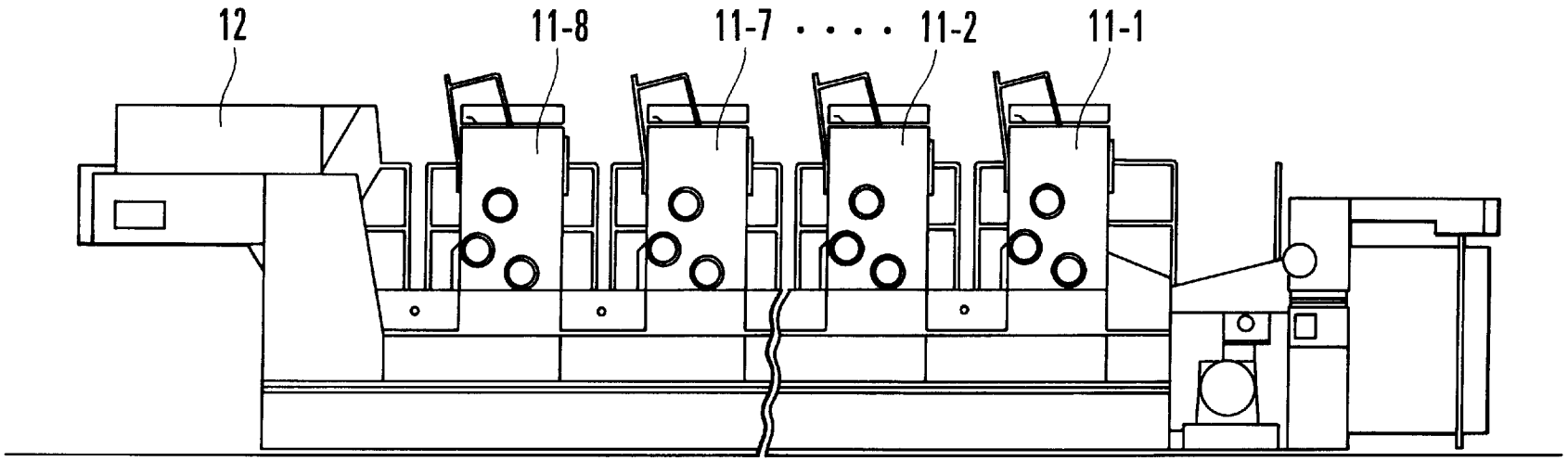
FIG. 2 is a side view of an 8-color sheet-fed web offset printing press to which the present invention is applied.
Figure 9:
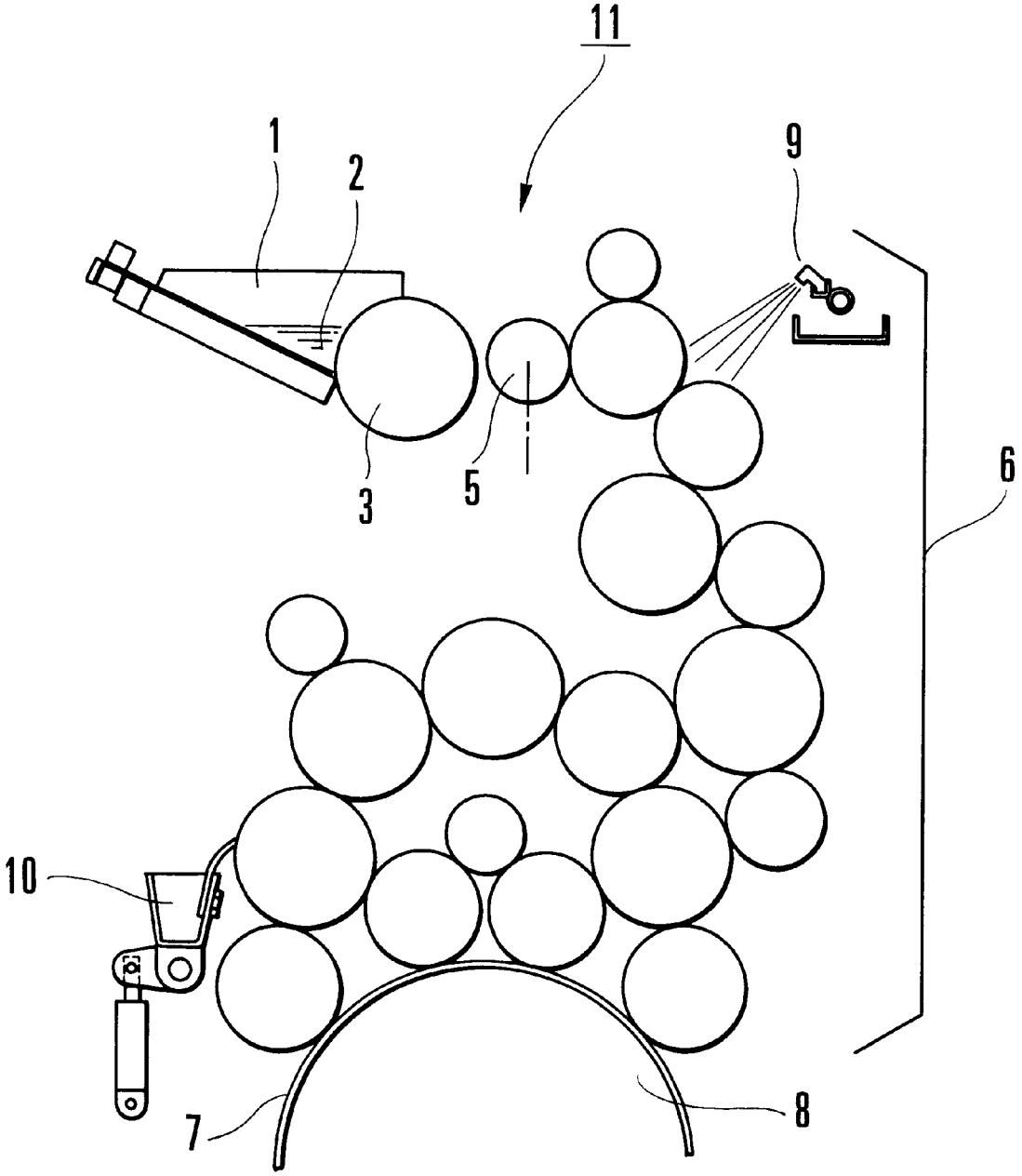
FIG. 9 is a schematic side view showing the main part of an ink supply unit.

FIG. 2 shows an 8-color sheet-fed web offset printing press to which the present invention is applied. Referring to FIG. 2, reference numerals 11-1 to 11-8 denote printing units of respective colors. An ink supply unit 11 corresponding to that shown in FIG. 9 is individually arranged in each of the printing units 11-1 to 11-8.

Figure 3:
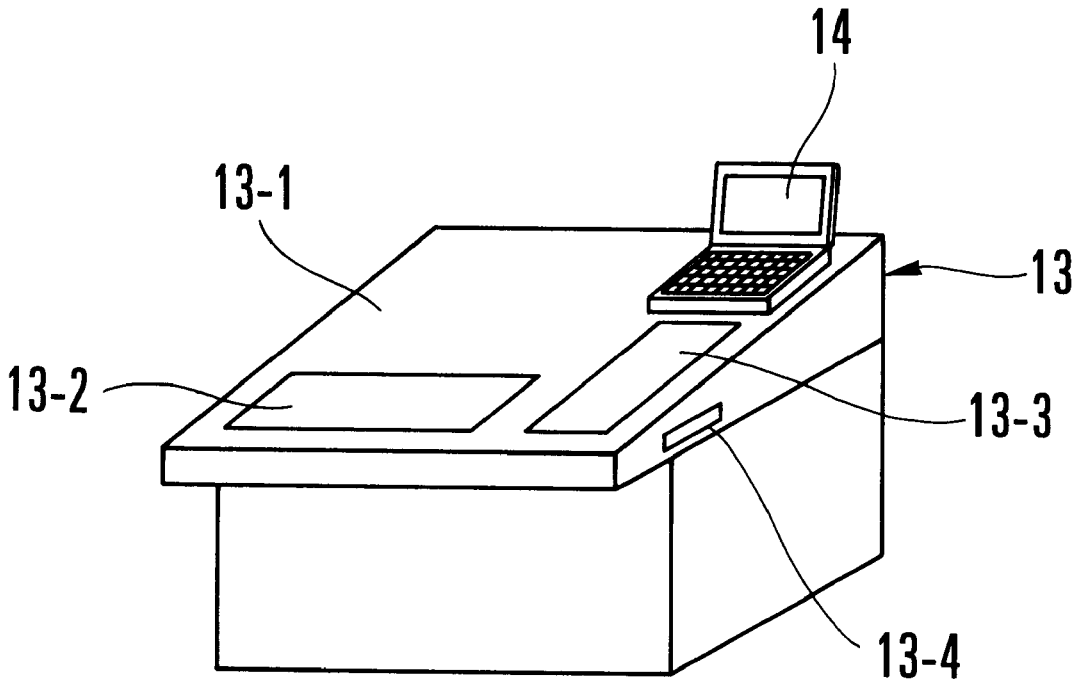
FIG. 3 is a perspective view of an operation desk provided to the web offset printing press shown in FIG. 2.

In this web offset printing press, an operation desk 13 as shown in FIG. 3 is arranged behind a delivery unit 12. The upper desk surface of the operation desk 13 forms an operation panel 13-1, and an operation unit 13-2 and a display 13-3 are arranged on the operation panel 13-1. A test printing control unit 14 comprising a personal computer is placed on the upper desk surface of the operation desk 13. A control unit (to be described later) is arranged in the operation desk 13. This control unit and the test printing control unit 14 constitute a test printing system.

Figure 4:
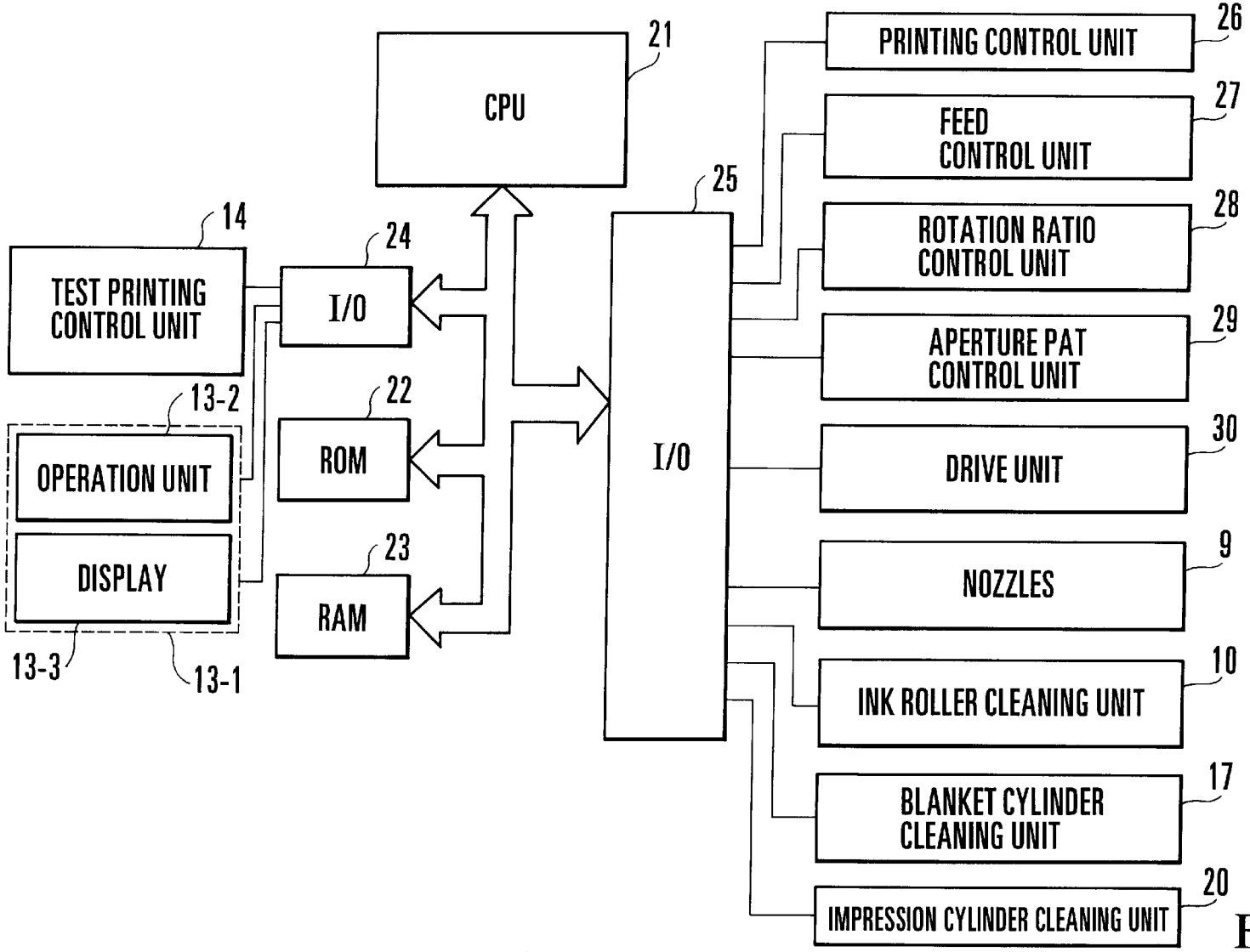
FIG. 4 is a block diagram of a printing press including the ink film thickness control apparatus according to an embodiment of the present invention.

FIG. 4 shows the electrical configuration of the printing press including the test printing system. Referring to FIG. 4, a CPU (Central Processing Unit) 21 performs various types of processing operations. A ROM (Read Only Memory) 22 stores various types of programs including those for ink supply and test printing. A RAM (Random Access Memory) 23 stores various types of data. Reference numerals 24 and 25 denote I/O interfaces, respectively. A printing control unit 26 controls the printing operation of the printing press. A feed control unit 27 controls the ON/OFF operation of the feed mechanism that feeds the ink. A rotation ratio control unit 28 controls the rotation ratio of the fountain roller. An aperture pat control unit 29 controls the opening degree of the ink keys. A drive unit 30 drives a recording medium, e.g., a floppy disk. The test printing control unit 14 and CPU 21 constitute the test printing system.

The I/O interface 24 is connected to the operation unit 13-2, display 13-3, and test printing control unit 14. The I/O interface 25 is connected to nozzles 9 (FIGS. 8 and 9), an ink roller cleaning unit 10 (FIGS. 8 and 9), a blanket cylinder cleaning unit 17 (FIG. 8), an impression cylinder cleaning unit 20 (FIG. 8), the printing control unit 26, the feed control unit 27, the rotation ratio control unit 28, the aperture pat control unit 29, and the drive unit 30. The nozzles 9, ink roller cleaning unit 10, blanket cylinder cleaning unit 17, impression cylinder cleaning unit 20, printing control unit 26, feed control unit 27, rotation ratio control unit 28, and aperture pat control unit 29 are provided for each of the printing units 11-1 to 11-8.

When the recording medium is a magnetic card, a card reader is connected to the I/O interface 25 in place of the drive unit 30.

The CPU 21 obtains various types of input information supplied through the I/O interfaces 24 and 25 and accesses the RAM 23 to perform various types of processing operations in accordance with the programs stored in the ROM 22. The various types of processing information in the CPU 21 are sent to the display 13-3, the test printing control unit 14, the printing control unit 26, the feed control unit 27, the rotation ratio control unit 28, the aperture pat control unit 29, the drive unit 30, the nozzles 9, the ink roller cleaning unit 10, the blanket cylinder cleaning unit 17, and the impression cylinder cleaning unit 20.

Standardized test printing data is loaded in the test printing control unit 14. In this case, the test printing data includes preset conditions such as the ink feed count (ink ductor count), the test printing sheet count, the removing sheet count, and the like for each of "pre-inking I", "ink removing", "pre-inking II", "pre-inking (+)", and "pre-inking (−)".

"Pre-inking I" is an operation of forming the first ink film thickness distribution (to be described later) and thereafter forming the second ink film thickness distribution (to be described later) on it. "Ink removing" is an operation of removing the second ink film thickness distribution and forming the first ink film thickness distribution. "Pre-inking II" is an operation of forming the second ink film thickness distribution on the already formed first ink film thickness distribution. "Pre-inking (+)" and "pre-inking (−)" are operations of increasing/decreasing the second ink film thickness distribution.

Figure 5A:
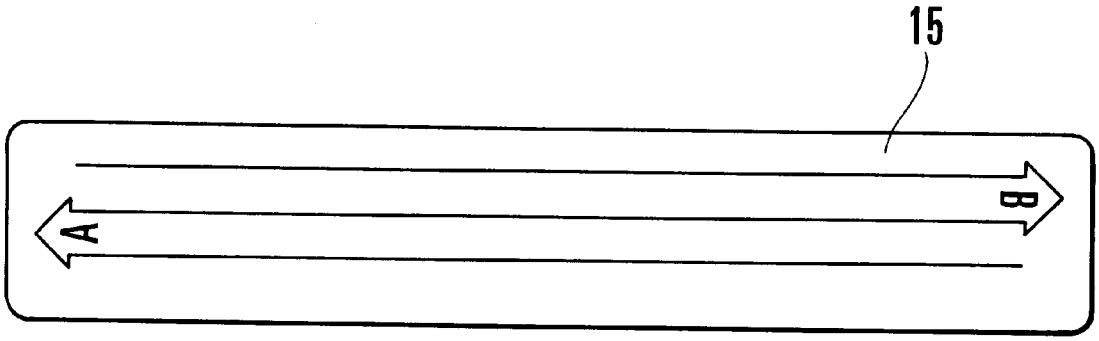
FIGS. 5A and 5B are plan views of recording media recorded with printing data.
Figure 5B:
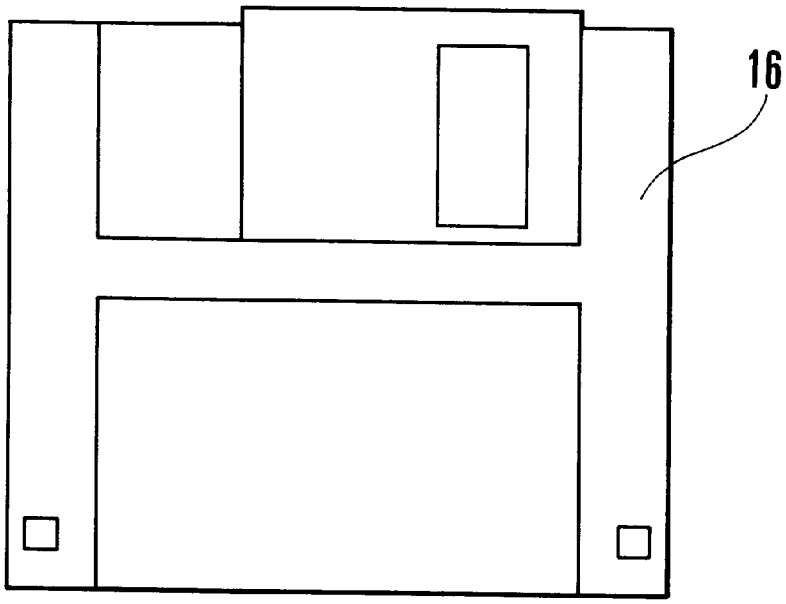

The operation panel 13-1 is formed with a slot 13-4 where a recording medium, e.g., a magnetic card 15 shown in FIG. 5A or a floppy disk 16 shown in FIG. 5B, is inserted and set. In this embodiment, a recording medium on which final printing data (printing data) created on the basis of the image area information of the printing plate is recorded is set in the slot 13-4. More specifically, preset data, e.g., the printing units used in units of printing plates, the opening degree of the ink fountain keys of the corresponding printing units, and the rotation ratio of the ink fountain roller, are recorded on the recording medium as the final printing data. The recording medium may be set in the test printing control unit 14, and the test printing control unit 14 may read the final printing data.

Figure 6:
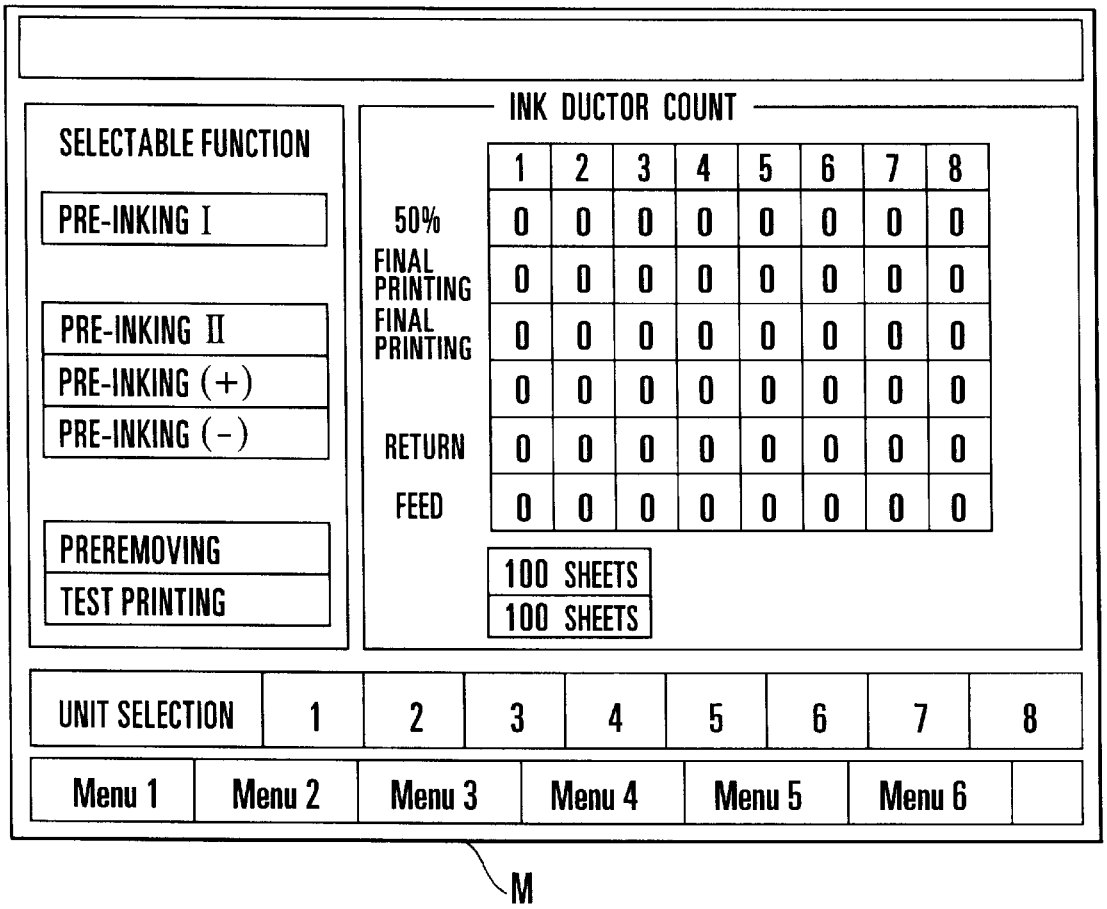
FIG. 6 is a view showing the menu window of a test printing control unit shown in FIG. 3.

Data required for forming an optimum ink film thickness on the respective rollers of the ink roller group 6 are input to the test printing control unit 14. These data are input in a menu window M shown in FIG. 6. The CPU 21 is loaded with a function of instructing parallel processing of the "pre-inking I" operation and the "pre-inking II" operation, and a function of collating the selected function with the function of the printing unit.

An operation of forming the ink film thickness distribution on the ink roller group 6 in the web offset printing press having the above arrangement, when exchanging the printing plate in the printing units 11-1 to 11-8, will be described with reference to FIG. 1.

When the power supply of the test printing control unit 14 is turned on, the menu window W appears on its display. "Pre-inking I", "pre-inking II", "pre-inking (+)", "pre-inking (−)", "ink removing", and "test printing" are displayed on the menu window M as functions that can be selected. Numbers "1" to "8" corresponding to the printing units 11-1 to 11-8 are also displayed as "unit selection" items.

Figure 1:
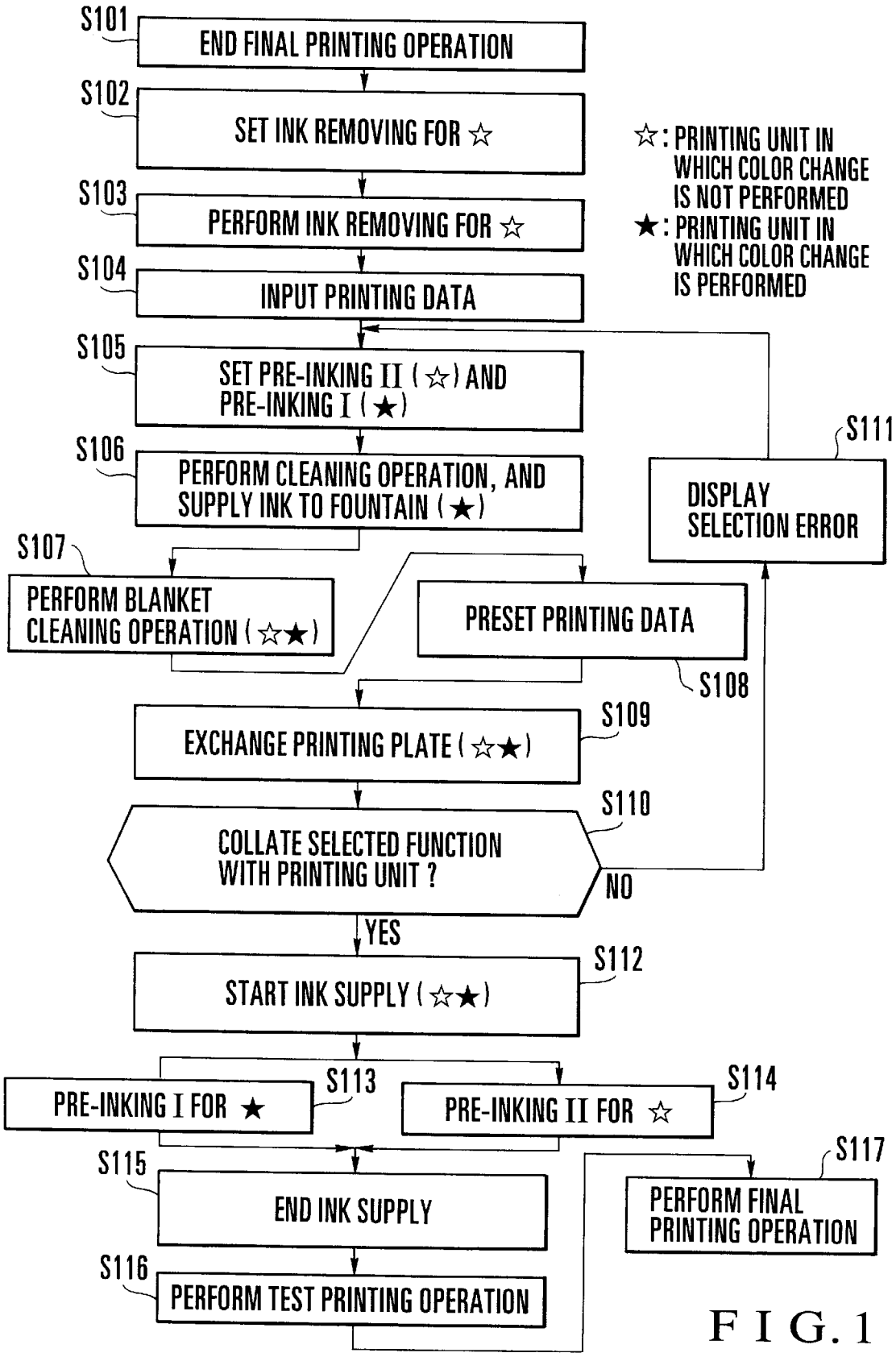
FIG. 1 is a flow chart for explaining an ink preset operation for an ink film thickness control apparatus shown in FIG. 4.

As shown in FIG. 1, the final printing operation is ended (step S101), and thereafter the old printing plate is exchanged for the new printing plate 7 in each of the printing units 11-1 to 11-8. In this case, for example, assume that color change is not performed in the printing units 11-1, 11-2, 11-7, and 11-8, and is performed in the four printing units, i.e., the printing units 11-3 to 11-6.

In this case, of the "unit selection" items displayed on the menu window M of the test printing control unit 14, the operator selects numbers "1", "2", "7", and "8" corresponding to the printing units 11-1, 11-2, 11-7, and 11-8, and selects "ink removing" (step S102). More specifically, on the display, the operator sets the "ink removing" operation for the printing units 11-1, 11-2, 11-7, and 11-8 (step S102).

Figure 7A:
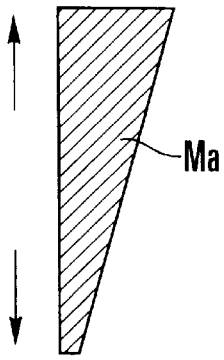
FIGS. 7A and 7B show the first and second ink film thickness distributions formed on the ink roller group.
Figure 7B:
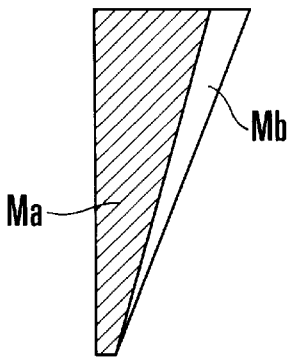

At this time, in the ink roller group 6 of each of the printing units 11-1, 11-2, 11-7, and 11-8, a second ink film thickness distribution Mb (see FIG. 7B) corresponding to the image of the printing plate 7 is superposed on a minimum first ink film thickness distribution Ma (see FIG. 7A) the thickness of which decreases from upward to downward and which is required during printing.

When the "ink removing" operation is set for each of the printing units 11-1, 11-2, 11-7, and 11-8, the CPU 21 turns off the feed operation of the ink ductor roller 5 in each of the printing units 11-1, 11-2, 11-7, and 11-8, and operates the printing press while the old printing plate is kept mounted, to perform printing for a predetermined sheet count. As a result, the first ink film thickness distribution Ma is left (step S103).

While performing the "ink removing" operation, printing is performed in a state wherein the feed operation of the ink ductor roller 5 is kept stopped, so the ink 2 in the ink fountain 1 is not supplied to the ink roller group 6 at all. Hence, of the ink held by the ink roller group 6, only a portion corresponding to the image portion of the old printing plate is consumed by printing. As a result, the ink history is eliminated, and the first ink film thickness distribution Ma remains.

After the "ink removing" operation is ended, the operator sets, in the slot 13-4, the recording medium recorded with the final printing data for the new printing plate 7 which is to be set in each of the printing units 11-1 to 11-8 (step S104). Subsequently, the operator sets which one of the "pre-inking I" operation and the "pre-inking II" operation is to be performed for each of the printing units 11-1 to 11-8 (step S105).

More specifically, of the "unit selections" items displayed on the menu window M, the operator selects numbers "1 ", "2", "7", and "8" corresponding to the printing units 11-1, 11-2, 11-7, and 11-8, and selects "pre-inking II". Then, the operator selects numbers "3", "4", "5", and "6" corresponding to the printing units 11-3, 11-4, 11-5, and 11-6, and selects "pre-inking I".

More specifically, on the color display that displays the menu window M, the operator sets the "pre-inking II" operation for the printing units 11-1, 11-2, 11-7, and 11-8 in which color change is not performed, and sets the "pre-inking I" operation for the printing units 11-3, 11-4, 11-5, and 11-6 in which color change is performed. In this case, on the menu window M, the display color of the selected "pre-inking I" and "pre-inking II" is changed, showing a state wherein the two pre-inking functions are mixedly selected.

These setting operations are performed in accordance with the key operation from the keyboard of the test printing control unit 14.

The CPU 21 selects the printing units 11-3, 11-4, 11-5, and 11-6, in which color change is required, in accordance with the condition preset on the menu window M, and removes and cleans the ink held by the ink roller group 6 and stored in the ink fountain 1 by using the nozzles 9 and ink roller cleaning unit 10. After the ink is cleaned, a new ink is supplied to the ink fountain 1 by the operator (step S106).

Up to the above step, in each of the printing units 11-1, 11-2, 11-7, and 11-8 in which color change is not performed, the minimum ink film thickness distribution Ma required during printing is formed in the ink roller group 6, and in each of the printing units 11-3, 11-4 11-5, and 11-6 in which color change is performed, no ink film thickness distribution is formed (no ink is held) in the ink roller group 6 at all.

Figure 8:
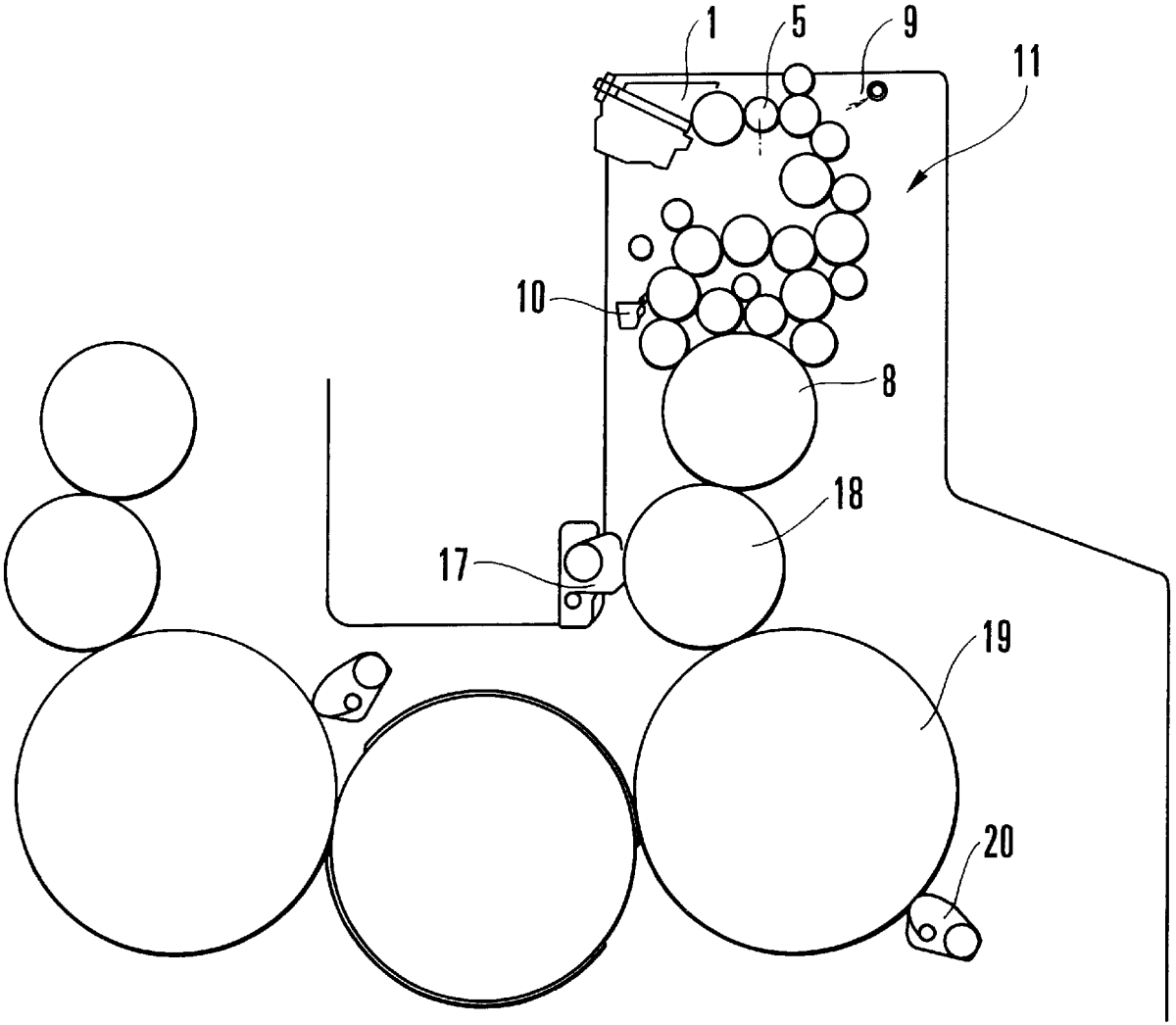
FIG. 8 is a schematic side view of a printing unit including respective cleaning units.

Subsequently, for each of the printing units 11-1 to 11-8, the operator actuates the blanket cylinder cleaning unit 17 shown in FIG. 8 to clean a blanket cylinder 18 (step S107). In FIG. 8, reference numeral 19 denotes an impression cylinder; and 20, the impression cylinder cleaning unit. For each of the printing units 11-1 to 11-8, the CPU 21 presets the final printing data read from the recording medium and set in step S104 (step S108). After the final printing data is preset, the operator exchanges the old plate for the new printing plate 7 in each of the printing units 11-1 to 11-8 (step S109).

After the plate is exchanged in each of the printing units 11-1 to 11-8, the CPU 21 collates the selected function with the function of the printing units 11-1 to 11-8 (step S110). More specifically, the selected function is automatically collated with the printing units 11-1 to 11-8 on the basis of the control result of ink removing and ink cleaning operation and the operation information of the printing press.

This will be described in detail. Whether the ink film thickness distribution formed in the ink roller group 6 of each of the printing units 11-1 to 11-8 matches the preset pre-inking operation set in step S105 is checked. More specifically, concerning the printing units for which the "pre-inking I" operation is set, whether their ink roller groups 6 hold the ink or not is checked. Concerning the printing units for which the "pre-inking II" operation is set, whether the minimum ink film thickness distribution Ma required during printing is formed in their ink roller groups 6 is checked.

More specifically, for the printing unit for which the "pre-inking I" operation is set, it is checked in step S102 that "ink removing" is not selected. For the printing unit for which the "pre-inking II" operation is set, it is checked in step S102 that ink removing is selected. Concerning checking of "pre-inking I", a sensor for detecting an ink may be arranged in the inker, and whether the ink is present may be detected directly. Alternatively, it may be checked in step S106 that the ink roller cleaning unit 10 is operated.

In this manner, in step S110, for the printing units 11-3, 11-4, 11-5, and 11-6 for which the "pre-inking I" operation is set, whether their ink roller groups 6 do not hold the ink is confirmed, and the flow advances to step S112. For the printing units 11-1, 11-2, 11-7, and 11-8 for which the "pre-inking II" operation is set, it is checked that the minimum ink film thickness distribution Ma required during printing is left in their ink roller groups 6, and the flow advances to step S112.

When matching cannot be obtained in step S110, of the "unit selection" items displayed on the menu window M, the test printing control unit 14 flashes the number of the corresponding printing unit (displays selection error) (step S111), to inform the operator of a selection error. In accordance with the displayed selection error, the operator changes (re-selects) the selection content in step S105.

In step S112, the CPU 21 starts the ink supply operation to the ink roller group 6 for each of the printing units 11-1 to 11-8. In this case, the CPU 21 performs the "pre-inking I" operation set for the printing units 11-3, 11-4, 11-5, and 11-6 in which color change is to be performed and the "pre-inking II" operation set for the printing units 11-1, 11-2, 11-7, and 11-8 in which color change is not to be performed, in a parallel manner (steps S113 and S114). In this case, if the function of either one of "pre-inking I" and "pre-inking II" is started, these two pre-inking functions start operation, so that the "pre-inking I" operation and the "pre-inking II" operation are performed in the parallel manner.

In the "pre-inking I" operation, the opening degree of ink fountain keys 4-1 to 4-n is set to a predetermined value (e.g., 50%), and the rotation ratio of the ink fountain roller 3 is set to a predetermined value (e.g., 50%). In this state, the printing press is operated, and the ink ductor roller 5 is caused to perform the feed operation a predetermined number of times, thereby forming the first ink film thickness distribution Ma in the ink roller group 6 (the first step of "pre-inking I").

Subsequently, after the opening degree of the ink fountain keys 4-1 to 4-n and the rotation ratio of the ink fountain roller 3 are set in accordance with the final printing data, the ink ductor roller 5 is caused to perform the feed operation a predetermined number of times, thereby superposing the second ink film thickness distribution Mb on the first ink film thickness distribution Ma which has been formed in the ink roller group 6 in the first step (the second step of "pre-inking I").

In the "pre-inking II" operation, the opening degree of the ink fountain keys 4-1 to 4-n and the rotation ratio of the ink fountain roller 3 are set in accordance with the final printing data, and thereafter the printing press is operated to cause the ink ductor roller 5 to perform the feed operation a predetermined number of times, thereby superposing the second ink film thickness distribution Mb on the first ink film thickness distribution Ma which is left in the ink roller group 6. Note that this "pre-inking II"operation is started in synchronism with the start of the second step of "pre-inking I" after the operation of the first step of "pre-inking I" is completed.

When the "pre-inking I" operation and "pre-inking II" operation in the steps S113 and S114, respectively, are ended (step S115), the test printing operation is performed (step S116), and the flow advances to the final printing operation (step S117).

The preset function is canceled by operating an exclusive key on the keyboard of the test printing control unit 14.

Figure 10:
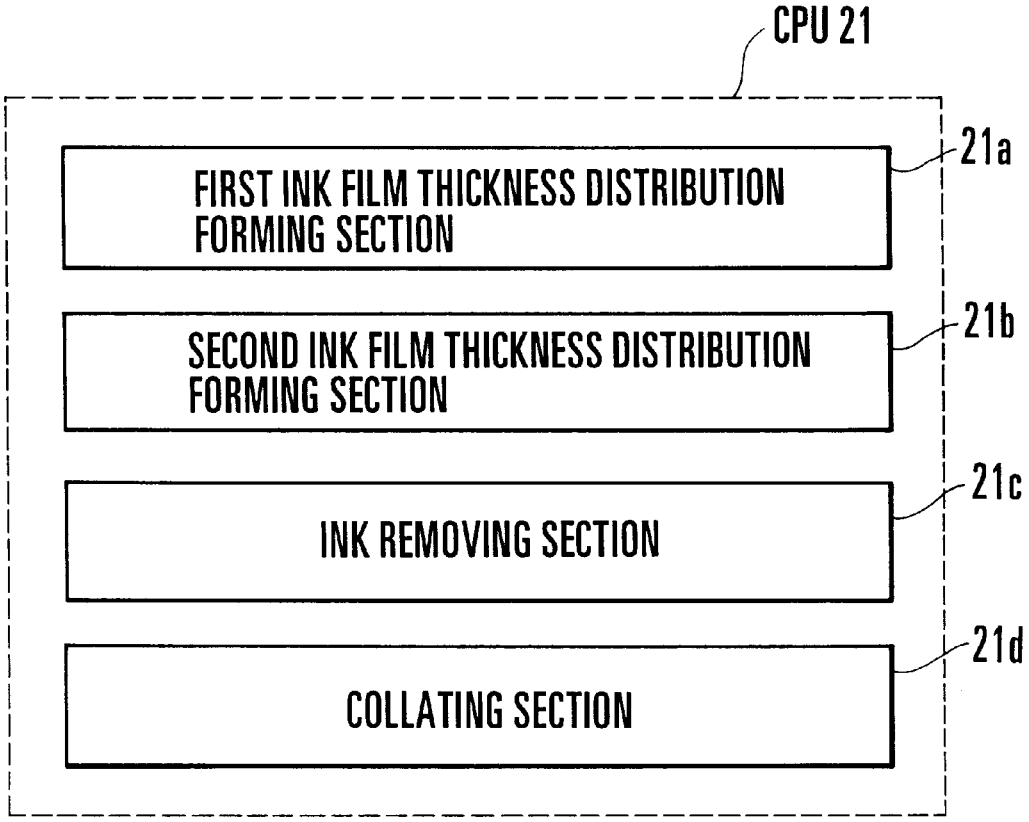
FIG. 10 is a functional block diagram of a CPU shown in FIG. 4.

FIG. 10 shows the function of the CPU 21 shown in FIG. 4. Referring to FIG. 10, a first ink film thickness distribution forming section 21*a* performs the "pre-inking I" operation of step S113 shown in FIG. 1. A second ink film thickness distribution forming section 21*b* performs the "pre-inking II" operation of step S114. An ink removing section 21*c* performs the "ink removing" operation of S103. A collating section 21*d* performs the collating operation of step S110. In the above embodiment, the unit which performs the pre-inking I operation is explained as the unit which performs color change. This operation can be similarly performed in a unit used for the first time, as a matter of course.

In the above embodiment, the test printing control unit 14 is defined as the test printing control means and the CPU 21 is defined as the processing control means, so that they constitute the test printing system. However, all setting/control processing operations concerning ink film thickness control may be performed by a personal computer constituting the test printing control unit 14. Inversely, a personal computer may not be used, but all setting/control processing operations concerning ink film thickness control may be performed by the CPU 21 that controls the printing press.

As has been described above, according to the present invention, in the printing unit for which the "pre-inking I" operation is set, the minimum first ink film thickness distribution required during printing is formed in the ink roller group in the inker, and thereafter the second ink film thickness distribution corresponding to the image of the printing plate is superposed on the first ink film thickness distribution. In the printing unit for which the "pre-inking II" operation is set, the second ink film thickness distribution corresponding to the image of the printing plate is superposed, by the "ink removing" operation, on the minimum first ink film thickness distribution left in the ink roller group and required during printing. As a result, a time required for setting the ink film thickness distribution to the one necessary for the new printing plate is shortened, to reduce pre-printing preparation time, decrease the labor load, economize the printing material, improve the production efficiency, and decrease the production cost.

Since the "pre-inking I" operation and the "pre-inking II" operation are performed in each printing unit in the parallel manner, a time required until the start of final printing is shortened, so that the productivity is improved and the production cost can be decreased. Even if the ink film thickness distribution forming operations are different among individual printing units, they are performed in the respective printing units in a parallel manner with only a single setting operation, so that the work load on the operator is largely decreased. Since an operation error is prevented by checking matching of settings, an ink film thickness correcting operation becomes unnecessary.

What is claimed is:

1. An ink film thickness control method comprising the steps of:

removing, for a predetermined one of a plurality of printing units respectively having ink supply units which include ink roller groups and connected in series to perform multi-color printing, a second ink film thickness distribution, corresponding to an image on an old printing plate, on a minimum first ink film thickness distribution formed on a surface of an ink roller group and required during printing, thereby leaving the first ink film thickness distribution;

setting which one of pre-inking I mode and pre-inking II mode is to be performed for each of said printing units;

forming the minimum first ink film thickness distribution required during printing on said surface of said ink roller group of a printing unit set in the pre-inking I mode after a new printing plate is mounted in said printing unit set in the pre-inking I mode;

superposing a second ink film thickness distribution, corresponding to the image of said new printing plate, on the first ink film thickness distribution; and simultaneously forming, for said printing unit set in the pre-inking II mode, a second ink film thickness distribution on the first ink film thickness distribution which has already been formed.

2. A method according to claim 1, wherein said method further comprises the step of performing an ink cleaning operation in an ink supply unit in order to exchange an ink for said printing unit after the pre-inking I mode is set, and the step of forming the first ink film thickness distribution comprises the forming operation of the first ink film thickness distribution after ink cleaning for ink exchange and exchange to the new printing plate.

3. A method according to claim 1, wherein said method further comprises the step of setting, for each of said printing units, an ink removing mode of removing the second ink film thickness distribution on the first ink film thickness distribution formed on said surface of said ink roller group, thereby leaving the first ink film thickness distribution, and the step of removing the second ink film thickness distribution comprises performing an ink film thickness removing operation for said printing unit set in an ink removing mode.

4. A method according to claim 3, wherein said method further comprises the step of performing collation to confirm that the pre-inking II mode is set for said printing unit set in the ink removing mode and that the pre-inking I mode is set for said printing unit not set in the ink removing mode, and the operations of pre-inking I and pre-inking II are performed when a collation result is correct.

5. A method according to claim 4, further comprising the steps of performing error display when the collation result is incorrect, and setting the pre-inking I mode and the pre-inking II mode again.

6. A method according to claim 1, wherein the operation of forming the second ink film thickness distribution in the pre-inking I mode and the pre-inking II mode is synchronously performed in all of said printing units.

7. A method according to claim 1, wherein the pre-inking I mode is set for a printing unit in which color change is performed, and the pre-inking II mode is set for a printing unit in which color change is not performed.

8. An ink film thickness control apparatus comprising:

a plurality of printing units connected in series to perform multi-color printing, said printing units respectively having ink supply units including ink roller groups;

first ink film thickness distribution forming means for forming a minimum first ink film thickness distribution, required during printing, on a surface of an ink roller group, and thereafter continuously forming a second ink film thickness distribution corresponding to an image of a new printing plate;

ink removing means for removing the second ink film thickness distribution on the first ink film thickness distribution formed on said surface of said ink roller group, thereby leaving the first ink film thickness distribution;

second ink film thickness distribution forming means for superposing the second ink film thickness distribution on the first ink film thickness distribution left on said surface of said ink roller group; and mode setting means for setting which one of pre-inking I mode and pre-inking II mode is to be performed for each of said printing units, wherein after exchange for a new printing plate is ended, said first and second ink film thickness distribution forming means perform operations of the pre-inking I mode and the pre-inking II mode for corresponding ones of said printing units mounted with the new printing plates in accordance with a preset content of said mode setting means.

9. An apparatus according to claim 8, wherein said apparatus further comprises ink cleaning means for performing an ink cleaning operation in an ink supply unit in order to exchange an ink for a printing unit set in the pre-inking I mode, and said first and second ink film thickness distribution forming means perform the pre-inking I mode and the pre-inking II mode after ink cleaning for ink exchange and exchange to the new printing plate.

10. An apparatus according to claim 8, wherein said mode setting means sets, for each of said printing units, an ink removing mode of removing the second ink film thickness distribution on the first ink film thickness distribution formed on said surface of said ink roller group, thereby leaving the first ink film thickness distribution, and said ink removing means performs an ink film thickness removing operation for a printing unit set by said mode setting means.

11. An apparatus according to claim 10, wherein said apparatus further comprises collating means for performing collation to confirm that the pre-inking II mode is set for a printing unit set in the ink removing mode and that the pre-inking I mode is set for a printing unit not set in the ink removing mode, and said first and second ink film thickness distribution forming means perform the operations of pre-inking I and pre-inking II, respectively, when a collation result is correct.

12. An apparatus according to claim 11, wherein said apparatus further comprises error display means for performing error display when the collation result is incorrect, and the pre-inking I mode and the pre-inking II mode are set again by said setting means in response to the error display.

13. An apparatus according to claim 8, wherein said first and second ink film thickness distribution forming means perform an operation of forming the second ink film thickness distribution in the pre-inking I mode and the pre-inking II mode synchronously in all of said printing units.

14. An apparatus according to claim 8, wherein the pre-inking I mode is set for a printing unit in which color change is performed, and the pre-inking II mode is set for a printing unit in which color change is not performed.

* * * * *

UNITED STATES PATENT AND TRADEMARK OFFICE

CERTIFICATE OF CORRECTION

PATENT NO. : 5,988,067
DATED : November 23, 1999
INVENTOR(S) : Ishida et al.

It is certified that error appears in the above-identified patent and that said Letters Patent is hereby corrected as shown below:

Title page,
Item [30], Foreign Application Priority Data, replace application number "9-359634" with -- 359634/1997 --.

Signed and Sealed this

Eighth Day of January, 2002

*Attest:*

*Attesting Officer*

JAMES E. ROGAN
*Director of the United States Patent and Trademark Office*